US011498338B2

(12) United States Patent
Yamada

(10) Patent No.: US 11,498,338 B2
(45) Date of Patent: Nov. 15, 2022

(54) INK TANK AND LEAKAGE INSPECTION METHOD FOR INK TANK

(71) Applicant: CANON KABUSHIKI KAISHA, Tokyo (JP)

(72) Inventor: Yuya Yamada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/360,632

(22) Filed: Jun. 28, 2021

(65) Prior Publication Data

US 2022/0001668 A1 Jan. 6, 2022

(30) Foreign Application Priority Data

Jul. 1, 2020 (JP) ..... JP2020-114209

(51) Int. Cl.
*B41J 2/175* (2006.01)

(52) U.S. Cl.
CPC ..... *B41J 2/175* (2013.01)

(58) Field of Classification Search
CPC ..... B41J 2/17556; B41J 2/17503; B41J 2/175
See application file for complete search history.

(56) References Cited

U.S. PATENT DOCUMENTS

| | | | | |
|---|---|---|---|---|
| 6,733,117 | B2 * | 5/2004 | Tajima | B41J 2/17556 347/87 |
| 7,111,931 | B2 * | 9/2006 | Amma | B41J 2/17596 347/94 |
| 2002/0118242 | A1 | 8/2002 | Tajima | |
| 2002/0140789 | A1 | 10/2002 | Tajima | |
| 2010/0123767 | A1 | 5/2010 | Takata | |

FOREIGN PATENT DOCUMENTS

| | | | |
|---|---|---|---|
| EP | 1231065 | B1 | 12/2008 |
| JP | 59007237 | A | 1/1984 |
| JP | 2002-307712 | A | 10/2002 |
| JP | 2005280075 | A | 10/2005 |
| JP | 2007245568 | A | 9/2007 |
| JP | 4507172 | B2 | 7/2010 |

* cited by examiner

*Primary Examiner* — An H Do
(74) *Attorney, Agent, or Firm* — Canon U.S.A., Inc. I.P. Division

(57) ABSTRACT

An ink tank includes an ink storage portion configured to store ink, and a flexible damper portion configured to communicate with an inside of the ink storage portion through a communication hole. A protruding portion protruding from an ink storage portion side toward an inside of the damper portion is formed in the inside of the damper portion. When viewed from a direction in which the protruding portion protrudes, the damper portion surrounds an entire circumference of the communication hole, and an opening portion is formed in the protruding portion.

13 Claims, 14 Drawing Sheets

INK TANK AND LEAKAGE INSPECTION METHOD FOR INK TANK

BACKGROUND OF THE INVENTION

Field of the Invention

The present invention relates to an ink tank and a leakage inspection method for the ink tank.

Description of the Related Art

Some ink-jet recording apparatuses that eject ink from ejection ports include ink tanks provided with ink storage portions for storing the ink. In a case where ink is ejected at a high ratio with respect to a total number of ejection ports, an ink amount to be supplied to the ink storage portion becomes insufficient with respect to an ink amount to be ejected. The examples of the case include a case where the ink is ejected from all of the ejection ports. When the ink amount to be supplied to the ink storage portion becomes insufficient, the pressure inside the ink storage portion may drop rapidly, and the supply of the ink to the ejection ports may become unstable. According to Japanese Patent Application Laid-Open No. 2002-307712 discusses an ink-jet recording head that can suppress a rapid pressure change in an ink storage portion by attaching a flexible damper portion to the ink storage portion. Japanese Patent Application Laid-Open No. 2002-307712 discusses a technique that suppresses a rapid pressure fluctuation in the ink storage portion by communicating an inside of the damper portion and an inside of the ink storage portion through a communication hole formed on a wall surface of the ink storage portion.

Japanese Patent Application Laid-Open No. 59-007237 discusses a leakage inspection method to inspect whether a plurality of members is properly connected. If such a leakage inspection method is applied to the ink tank discussed in Japanese Patent Application Laid-Open No. 2002-307712, the leakage inspection is performed as follows. The inside of the ink storage portion and the inside of the damper portion are firstly sucked from an ink injection port (a port for filling the ink storage portion with ink), in a state in which the ink storage portion is connected to the damper portion. The suction is then stopped, and the ink tank is left for a certain period of time while measuring a pressure in the ink storage portion and the damper portion. In a case where the damper portion and the ink storage portion are properly connected, the pressure in the ink storage portion and the damper portion hardly changes even after the certain period of time has elapsed. In contrast, in a case where the damper portion and the ink storage portion are not properly connected, the pressure gradually increases over time. The leakage inspection is performed based on such a difference in the pressure change.

If the flexible damper portion is deformed by suction, the deformed damper portion may block a communication hole formed between the inside of the damper portion and the inside of an ink storage portion in some cases. When the damper portion blocks the communication hole, the pressure inside the ink storage portion and the damper portion hardly decrease even though the damper portion and the ink storage portion are not properly connected. There is thereby a risk of an erroneous inspection in which the connection is determined as a proper state even though the connection between both members is in an improper state.

SUMMARY OF THE INVENTION

The present invention is directed to the provision of an ink tank which can suppress occurrence of an erroneous inspection due to blockage of a communication hole formed by a damper portion in an inspection (a leakage inspection) of a connection state of the damper portion and an ink storage portion in consideration of the above-described issue.

The present disclosure is thus directed to provide an ink tank which can suppress occurrence of an erroneous inspection due to blockage of a communication hole formed by a damper portion in an inspection (a leakage inspection) of a connection state of the damper portion and an ink storage portion.

In order to solve the above-described issue, an ink tank according to the present disclosure includes an ink storage portion configured to store ink, and a flexible damper portion configured to communicate with an inside of the ink storage portion via a communication hole. A protruding portion protruding from an ink storage portion side to an inside of the damper portion is formed in the inside of the damper portion. When viewed from a direction in which the protruding portion protrudes, the damper portion surrounds an entire circumference of the communication hole, and an opening portion is formed in the protruding portion.

Further features of the present invention will become apparent from the following description of exemplary embodiments with reference to the attached drawings.

DESCRIPTION OF THE EMBODIMENTS

Exemplary embodiments of the present invention will be described in detail below with reference to the attached drawings. An ink tank according to the present invention refers to an ink tank 13 including at least an ink storage portion 36 and a damper portion 10 described below.

(Ink-Jet Recording Apparatus)

Figure 1:
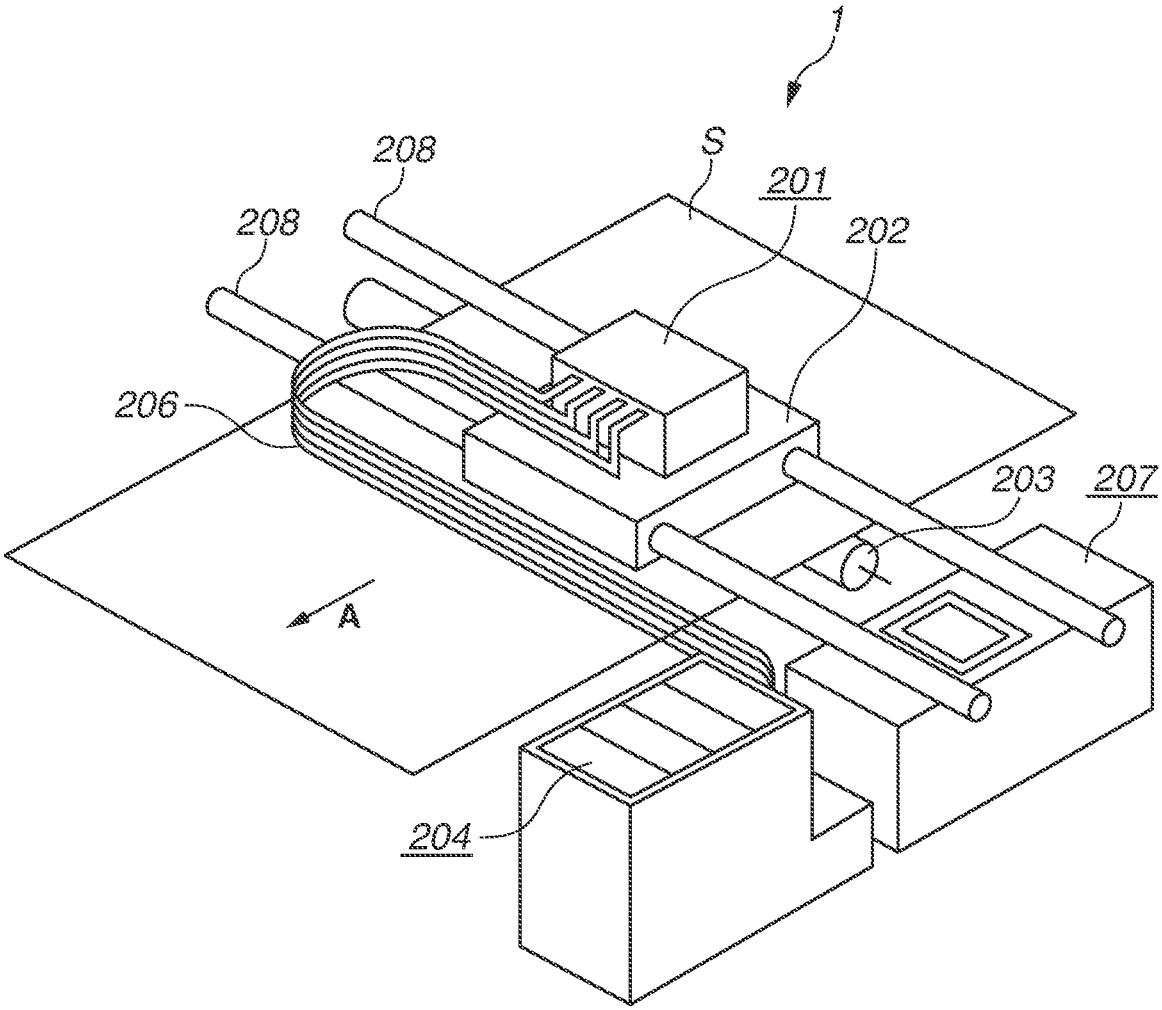
FIG. 1 is a perspective view of an ink-jet recording apparatus.

An ink-jet recording apparatus 1 to which the present invention can be applied is described with reference to FIG. 1. FIG. 1 is a perspective view of the ink-jet recording apparatus 1 to which the present invention can be applied. The ink-jet recording apparatus 1 repeats a reciprocating movement (main scanning) of an ink-jet head 201 and conveyance (sub scanning) of a recording medium S at a predetermined pitch. Further, the ink-jet recording apparatus 1 ejects ink from the ink-jet head 201 and attaches the ink to the recording medium S in synchronization with the above-described movements. The ink-jet recording apparatus 1 thereby forms a character, a symbol, an image, and the like onto the recording medium S. The recording medium S is conveyed by a conveyance roller 203, which is a conveyance unit, in a direction intersecting with a movement direction of a carriage 202 (e.g., a direction of an arrow A that is a direction perpendicular to the movement direction).

The ink-jet head 201 is detachably mounted on the carriage 202, which reciprocates on two guide rails 208. The ink-jet head 201 includes a plurality of ejection port arrays for ejecting a plurality of color inks. The ejection port array includes a plurality of ejection ports 29 (FIG. 4) for ejecting liquid. A main tank 204 is connected to the ink-jet head 201 via an ink supply tube 206 for each of the plurality of color inks.

A recovery unit 207 is arranged in an area within a reciprocating movement range of the ink-jet head 201 and an outside of a passing range of the recording medium S. The recovery unit 207 is arranged to face a surface 2 (hereinafter, referred to as an ejection port surface 2) (FIG. 4) on which the ejection port 29 of the ink-jet head 201 is formed. The recovery unit 207 includes a suction mechanism for forcibly sucking the ink from the ejection port 29 and a blade for wiping off dirt on the ejection port surface 2. The recovery unit 207 appropriately drives, for example, the suction mechanism, and the blade in a case where there is a problem with stable ejection of the ink, and can thereby return the ink-jet head 201 to a state in which the ink can be stably ejected.

(Ink-Jet Head)

Figure 2:
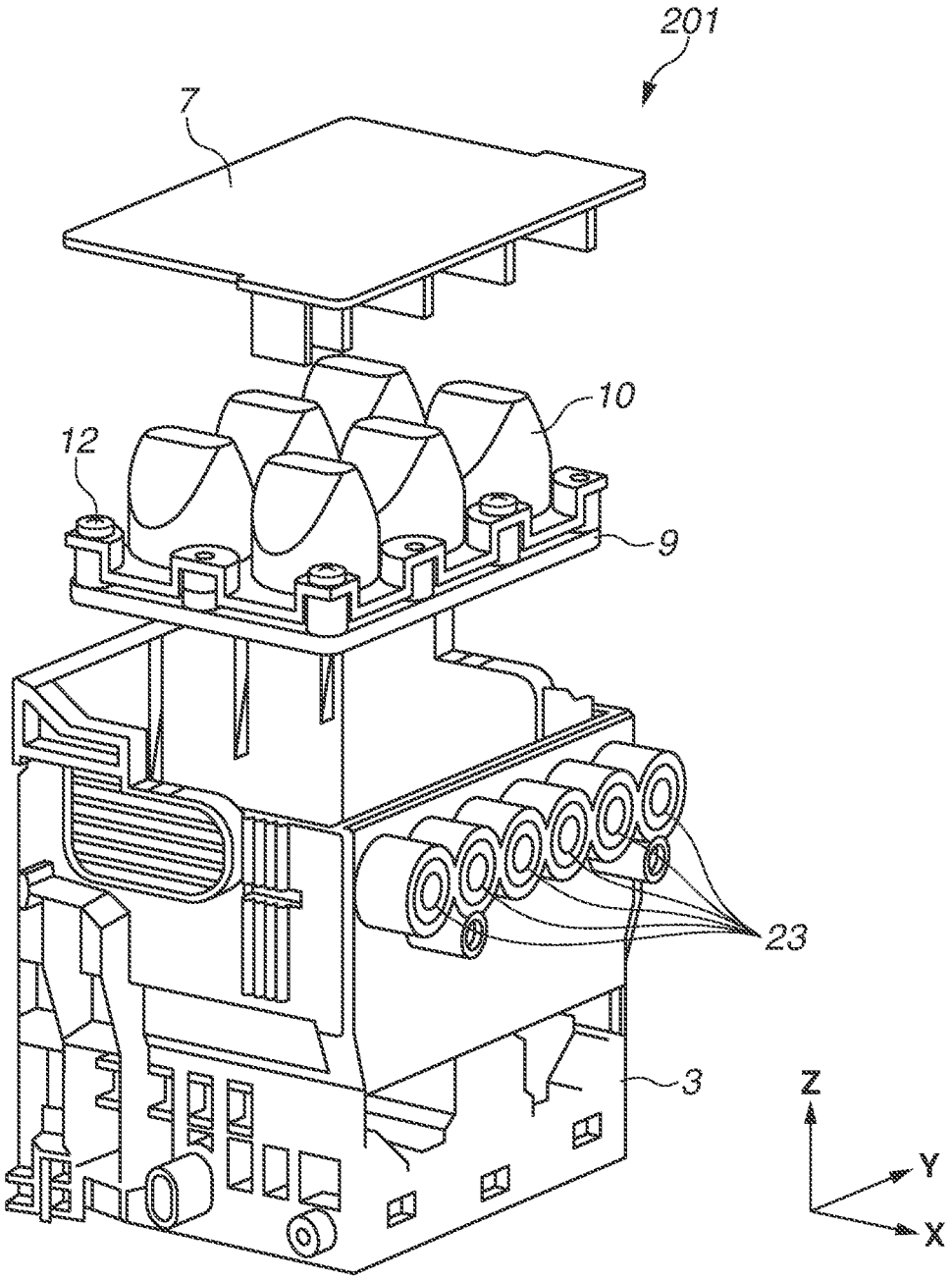
FIG. 2 is an exploded perspective view of an ink-jet head.

The ink-jet head 201 will now be described with reference to FIGS. 2 to 4. FIG. 2 is an exploded perspective view of the ink-jet head 201. The ink-jet head 201 is mainly configured with a housing 3, an element substrate 26, and the damper portions 10. The ink-jet head 201 includes six needle receiving portions 23 each of which is connected to the ink supply tube 206 (FIG. 1). The ink flowing from the main tank 204 through the ink supply tube 206 is therefore supplied into the ink-jet head 201 through the needle receiving portion 23.

Figure 3:
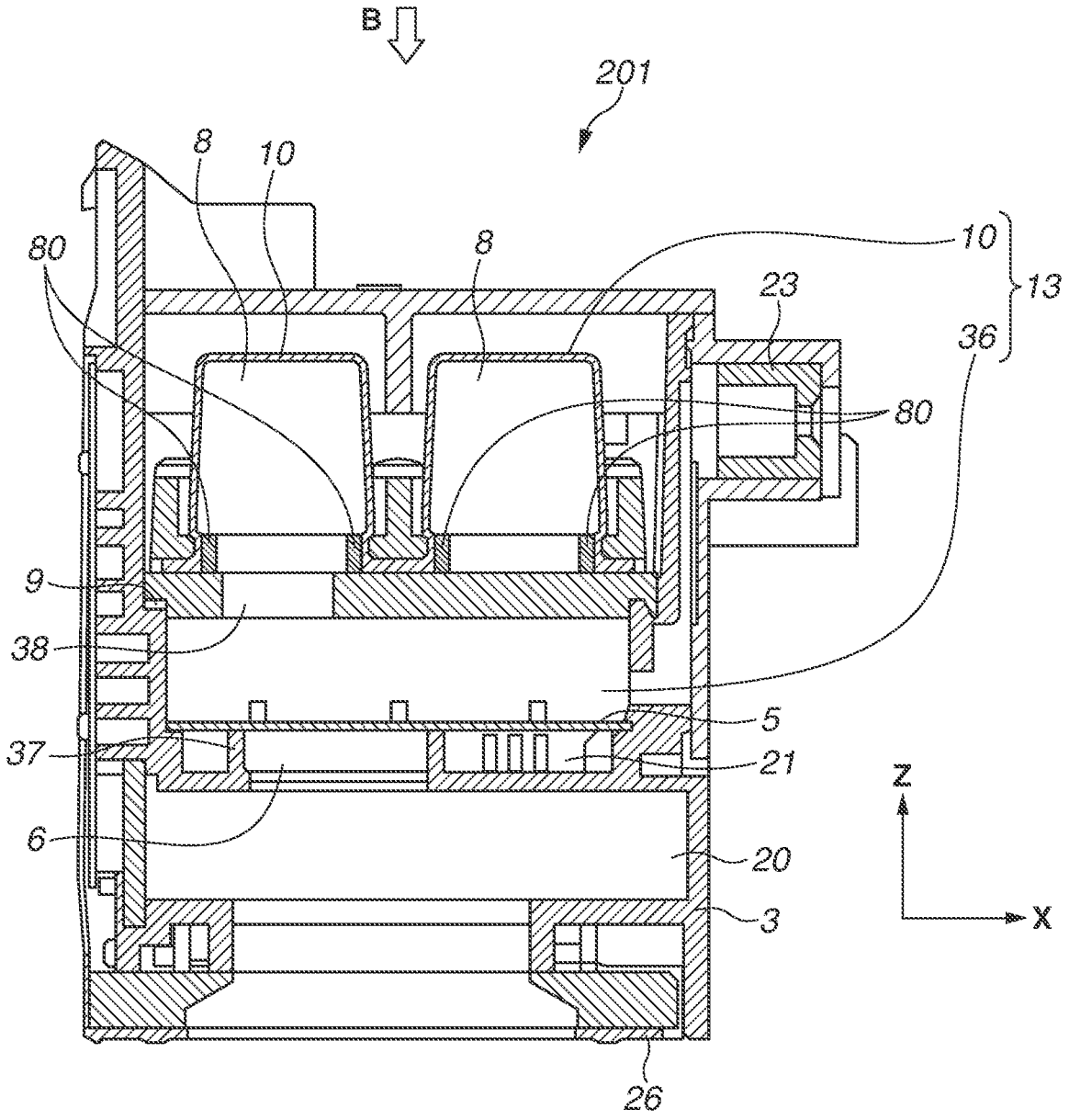
FIG. 3 is a cross-sectional view of the ink-jet head in a plane parallel to an X direction.

FIG. 3 is a cross-sectional view of the ink-jet head 201 in a plane parallel to an X direction and passing through the center of the needle receiving portion 23. FIG. 4 is a perspective view of the ink-jet head 201 viewed from an ejection port 29 side. The ink supplied into the ink-jet head 201 is stored in the ink storage portion 36 (hereinafter, also referred to as a sub tank 36 in the present specification). The ink stored in the ink storage portion 36 passes through a filter 5, which removes an impurity (a foreign substance) in the ink, and is temporarily reserved in an ink reservoir portion 21. The ink then passes through a communication portion 37 and a flow channel 6 to be supplied to a liquid chamber 20. The ink supplied to the liquid chamber 20 is supplied to the ejection port 29 disposed on the element substrate 26 illustrated in FIG. 4. An energy generating element is driven to generate energy for ejecting the ink from the ejection port, and thereby the ink is ejected from the ejection port.

As illustrated in FIG. 3, the ink-jet head 201 includes the ink tank 13 having the ink storage portion 36 and the damper portion 10. The damper portion 10 is made of a flexible material, such as rubber, and is attached to a sub tank lid (also referred to as an ink storage portion lid) 9, which forms a surface of an upper side (Z direction) of the sub tank 36. An inner space of the damper portion 10 communicates with an inside of the sub tank 36 through a communication hole 38 formed on the sub tank lid 9. In other words, the damper portion 10 is attached so as to cover the communication hole 38. The flexible damper portion 10 can thereby be deformed in response to the rapid pressure change in the sub tank 36, even in a case where all the ejection ports 29 eject the ink and a pressure in the sub tank 36 rapidly changes. In other words, a volume of an inner space 8 of the damper portion 10 increases or decreases according to the pressure change. The rapid pressure change in the sub tank 36 can thereby be suppressed. As will be described in detail below, a protruding portion 80 is formed on the sub tank lid 9. The damper portion 10 may be made of not only a member, such as rubber, but also a combination of a plastic sheet and a spring. Furthermore, a sub tank cover 7 is attached covering the damper portion 10 to protect the damper portion 10.

Figure 4:
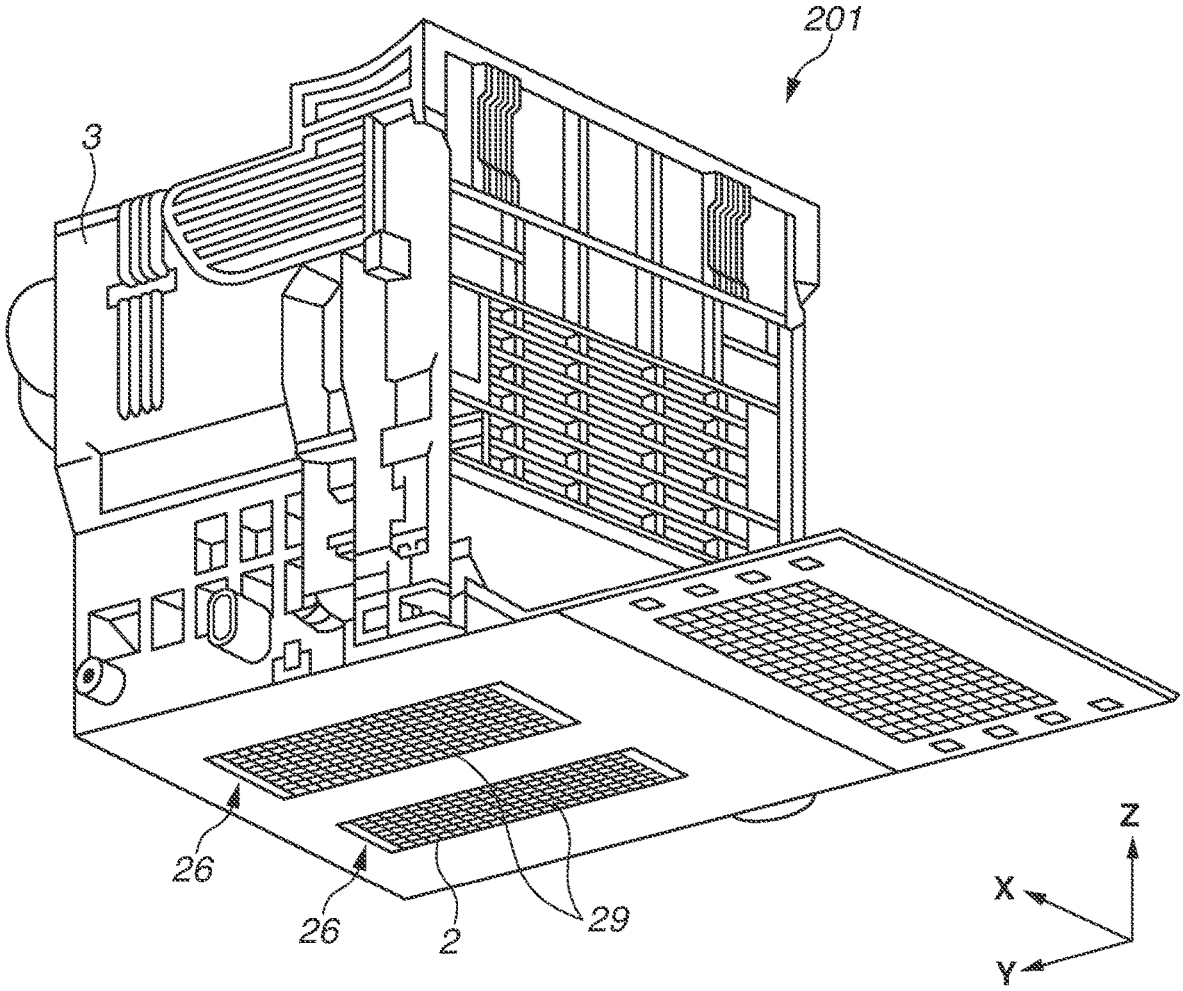
FIG. 4 is a perspective view of the ink-jet head viewed from an ejection port side.

Six pieces of sub tanks are formed in the ink-jet head 201 illustrated in FIGS. 2 to 4, and six damper portions 10 are attached according to the number of the sub tanks. However, a single piece of damper portion 10 may be formed to correspond to a plurality of the sub tanks, according to the present invention.

(Damper Portion)

Figure 5A:
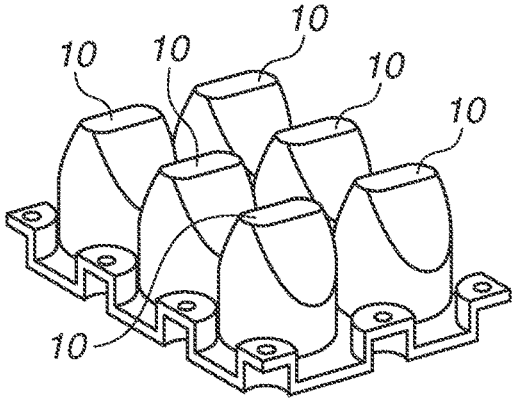
FIGS. 5A to 5C are schematic diagrams illustrating states of connections between damper portions and a sub tank lid.
Figure 5B:
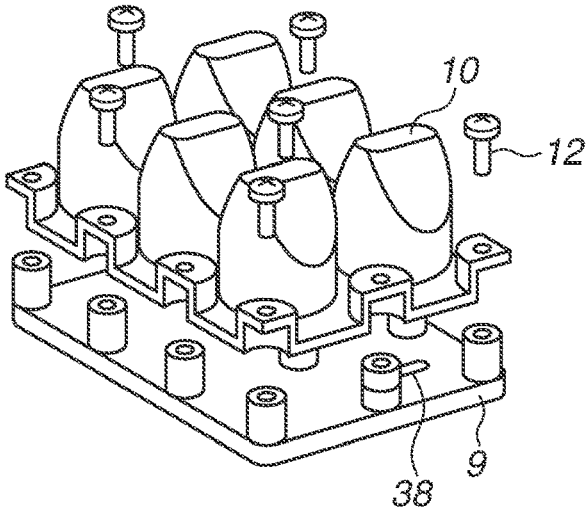
Figure 5C:
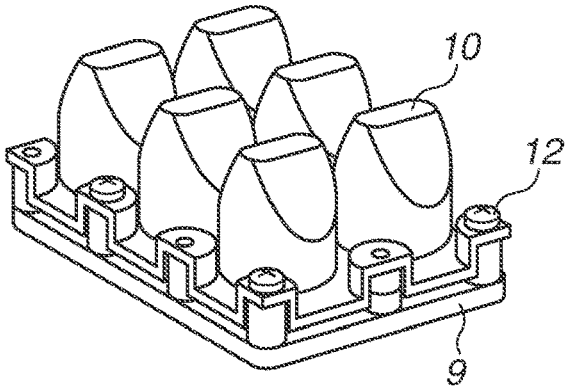

The damper portion 10 will be described with reference to FIGS. 5A to 8D. FIG. 5A is a perspective view of the damper portions 10. FIG. 5B illustrates a way of connecting the damper portions 10 and the sub tank lid 9. FIG. 5C illustrates a state in which the damper portions 10 are connected to the sub tank lid 9. As illustrated in FIG. 5A, a plurality of the damper portions 10 is integrally formed. Such damper portions 10 are attached to the sub tank lid 9 with screws 12 as illustrated in FIGS. 5B and 5C. Since the damper portions 10 are provided, a fluctuation in the pressure inside the ink storage portion 36 can be suppressed.

Figure 6:
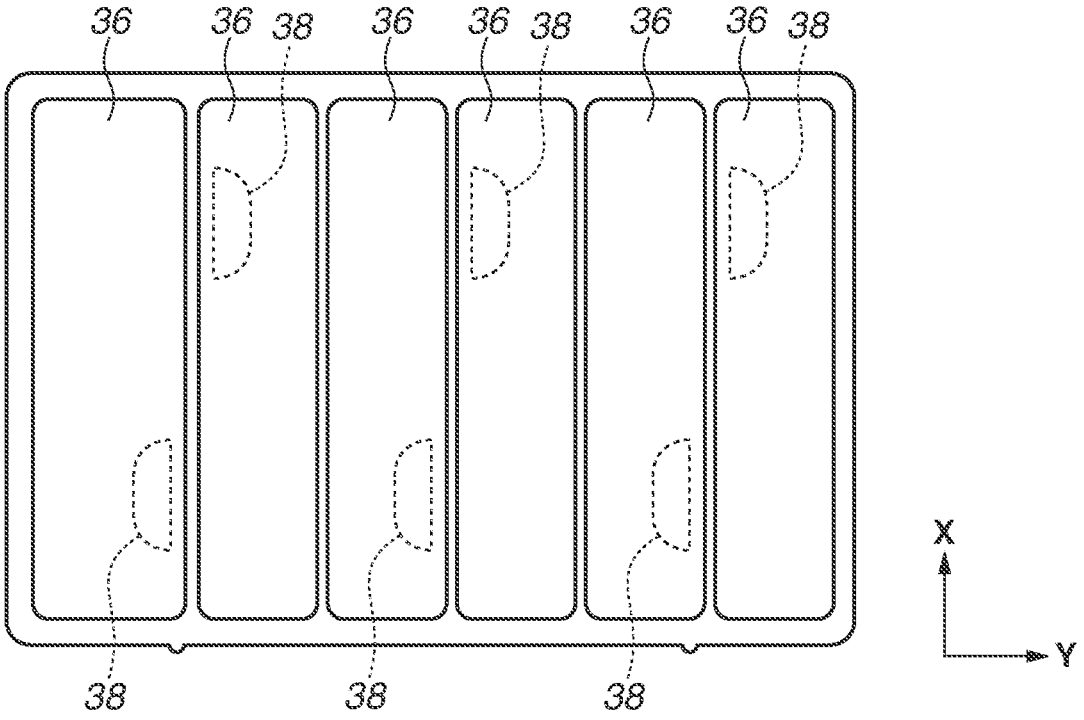
FIG. 6 is a top view of a sub tank.
Figure 7:
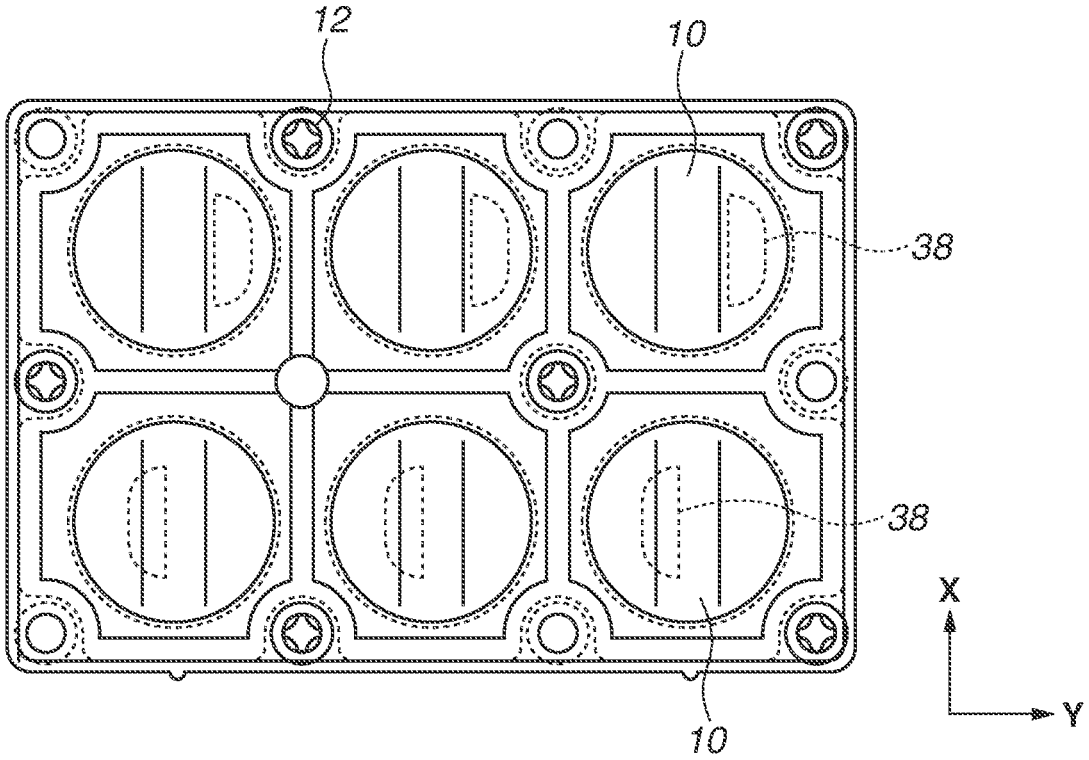
FIG. 7 is a schematic diagram illustrating a positional relationship between the damper portion and a communication hole.

FIG. 6 is a top view of the sub tanks 36 viewed from a B direction indicated in FIG. 3. In FIG. 6, positions of the communication holes 38 formed on the sub tank lid 9 are indicated by broken lines to indicate a positional relationship between the sub tanks 36 and the communication holes 38. FIG. 7 is a top view indicating a positional relationship between the damper portions 10 and the communication holes 38 in a case where the damper portions 10 are attached to the sub tanks 36. As illustrated in FIG. 6, the six sub tanks 36 are arranged in a Y direction inside the ink-jet head 201. A shape of each sub tank 36 is a rectangular parallelepiped shape that extends long in a direction (the X direction) intersecting an arrangement direction (the Y direction) of the sub tank 36. In addition, a plurality of the communication holes 38 is formed on the sub tank lid 9 to communicate with an inside of each sub tank 36. The plurality of the communication holes 38 is formed in a staggered pattern. This is because the six damper portions 10 are arranged in a 3*2 manner as illustrated in FIG. 7. By arranging the damper portions 10 in a 3*2 manner, each damper portion 10 can be arranged over upper sides of the two sub tanks 36. The damper portion 10 having a shape illustrated in FIGS. 8A to 8D described in detail below can thus be set to the sub tank 36 of which a width in the Y direction is limited.

Figure 8A:
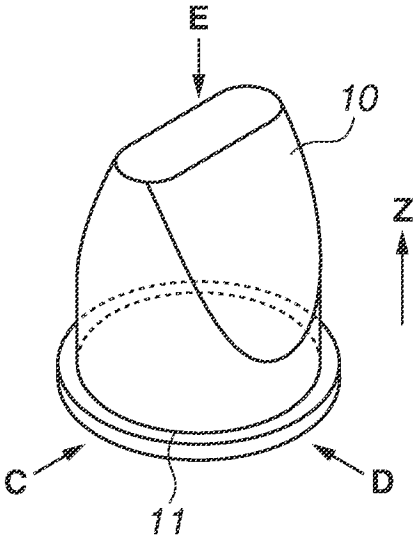
FIGS. 8A to 8D are schematic diagrams illustrating the damper portion.
Figure 8B:
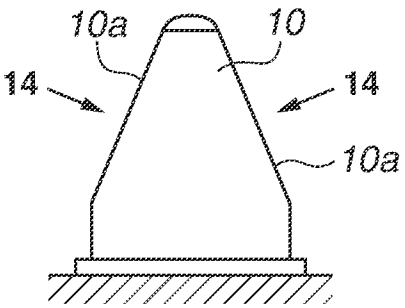
Figure 8C:
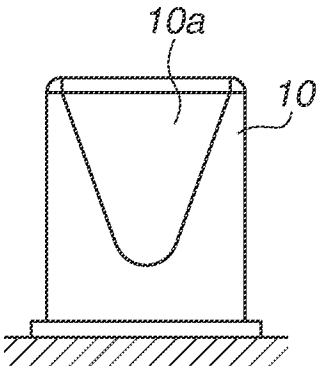
Figure 8D:
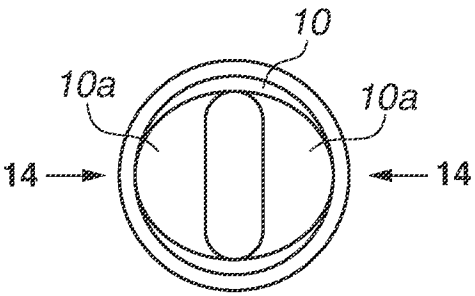

The shape of the damper portion 10 will be described in detail with reference to FIGS. 8A to 8D. FIG. 8A is a perspective view of the damper portion 10. FIG. 8B is a schematic diagram illustrating the damper portion 10 viewed from a C direction indicated in FIG. 8A. FIG. 8C is a schematic diagram illustrating the damper portion 10 viewed from a D direction indicated in FIG. 8A. FIG. 8D is a schematic diagram illustrating the damper portion 10 viewed from an E direction indicated in FIG. 8A. In order to secure a volume necessary for the inner space 8 of the damper portion 10 and to stably deform the damper portion 10, a shape of an opening 11 of the damper portion 10 on a side being in contact with the sub tank lid 9 is circular. The damper portion 10 has a shape, from a sub tank lid 9 side toward the Z direction, which includes first an area of which a cross section area of the inner space 8 is constant and then an area (an area of two flat surfaces 10*a*) in which the cross section area gradually decreases. In a case where the damper portion 10 having the above-described shape is deformed, first, the two flat surfaces 10*a* are recessed to approach each other (in a direction of an arrow 14).

(Protruding Portion)

Figure 9A:
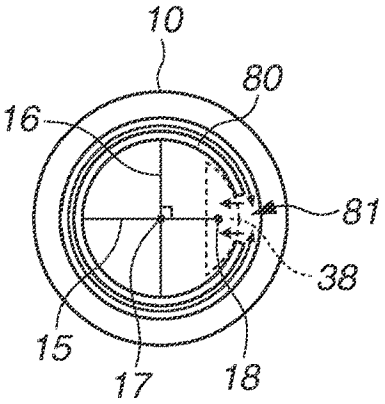
FIGS. 9A to 9D are schematic diagrams illustrating a protruding portion.
Figure 9B:
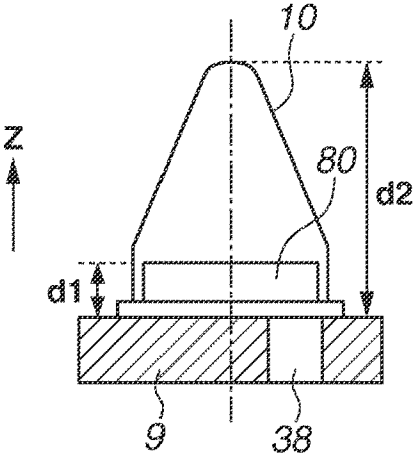
Figure 9C:
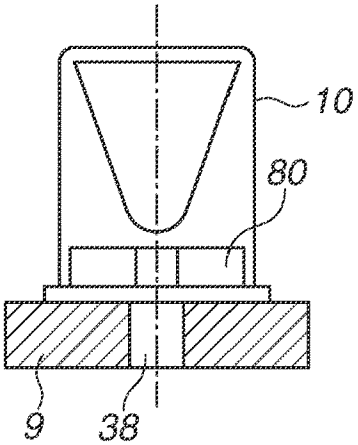
Figure 9D:
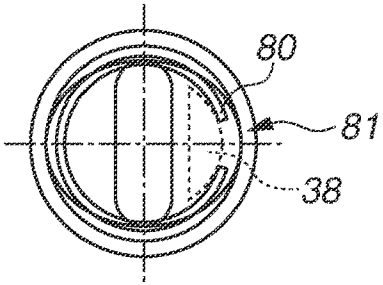

A protruding portion is provided to suppress the damper portion from blocking the communication hole and causing erroneous determination in a leakage inspection, according to a first exemplary embodiment. In addition, the protruding portion has a shape including a portion that does not surround the communication hole with one protruding portion at any height in a direction in which the protruding portion protrudes. The protruding portion will be described with reference to FIGS. 9A to 9D. FIG. 9A is a top view of the protruding portion 80 viewed from the E direction (a direction in which the protruding portion protrudes) illustrated in FIG. 8A. FIG. 9B is a schematic diagram illustrating the protruding portion 80 viewed from the C direction illustrated in FIG. 8A. FIG. 9C is a schematic diagram illustrating the protruding portion 80 viewed from the D direction illustrated in FIG. 8A. The protruding portion 80 is attached to the sub tank lid 9 and protrudes from an ink storage portion side toward an inside of the damper portion 10. In the top view in FIG. 9A, the protruding portion 80 is arranged between the communication hole 38 and the damper portion 10. The protruding portion 80 has a shape along the shape of the opening 11 of the damper portion 10. In other words, the protruding portion 80 having a substantially circular shape is formed to surround the communication hole 38 as illustrated in FIG. 9A, according to the present exemplary embodiment. If viewed from a direction in which the protruding portion 80 protrudes, the damper portion 10 surrounds an entire circumference of the communication hole 38.

If the damper portion 10 is deformed by a suction operation in a leakage inspection, the damper portion 10 sticks to the protruding portion 80. If one protruding portion 80 surrounds the communication hole 38, the damper portion 10 therefore sticks to an entire inner surface of the protruding portion 80 and blocks an inner space of the protruding portion 80 (a communication hole 38 side) from outside air. The inside of the sub tank 36 thereby becomes a closed space, and there is a risk of being erroneously determined that the damper portion 10 is properly sealed in the leakage inspection described below even though the damper portion 10 is not properly sealed. To avoid such erroneous determination, the protruding portion 80 according to the present invention has the shape including the portion which does not surround the communication hole 38 with one protruding portion 80 at any height in the direction (the Z direction) in which the protruding portion 80 protrudes. Including the portion which does not surround the communication hole 38 with one protruding portion 80 at any height means that the protruding portion 80 includes a portion in which the protruding portion 80 is not continuously formed as a ring. In contrast, a shape surrounding the communication hole 38 with one protruding portion at any height means that one protruding portion continuously formed without a gap in a constant height surrounds the communication hole 38. The above-described protruding portion 80 is formed on the sub tank lid 9, thus the damper portion 10 can be suppressed from blocking the communication hole 38 in the leakage inspection described below, and an erroneous inspection can be suppressed in the leakage inspection. In the leakage inspection, the damper portion 10 sticks to the protruding portion 80, but the protruding portion 80 includes the portion which does not surround the communication hole 38 with the one protruding portion, so that the damper portion 10 does not stick to the protruding portion 80 at the portion. The inside of the damper portion 10 thereby communicates with the inside of the ink storage portion 36 through the communication hole 38 at least at the portion which does not stick thereto, and the leakage inspection can be appropriately performed.

As a form of the protruding portion 80 having the shape which does not surround the communication hole 38 with one protruding portion 80, a notch portion (an opening portion) 81 is formed in the protruding portion 80 as illustrated in FIGS. 9A to 9D. The notch portion 81 refers to a portion of an area in which the protruding portion 80 is not formed as compared with the protruding portion having the shape surrounding the communication hole 38 with one protruding portion. Since the notch portion 81 is formed, the damper portion 10 does not stick to the protruding portion 80 at least at the notch portion 81, and the leakage inspection can be appropriately performed. If the protruding portion is viewed from the Z direction, the communication hole 38 is surrounded by one protruding portion. However, in a case where a slit is formed in the protruding portion, this protruding portion is also included in the protruding portion according to the present exemplary embodiment. In other words, the protruding portion includes a portion at which the communication hole 38 is not surrounded with one protruding portion at any height in the direction in which the protruding portion protrudes.

It is desirable that a height d1 of the protruding portion 80 is set to one-tenth or more of a height d2 of the damper portion 10. The height d1 of the protruding portion 80 refers to a height from the sub tank lid 9. Similarly, the height d2 of the damper portion 10 refers to a height from the sub tank lid 9. If the height of the protruding portion 80 is low, it is more likely that the damper portion 10 recessed by the suction in the leakage inspection described below will block the communication hole 38. Thus, the protruding portion 80 needs to have a certain height that is more desirably one-fifth or more of the height of the damper portion 10, and further more desirably one-third or more of the height of the damper portion 10. However, if the height of the protruding portion 80 is too high, there is a risk of hindering deformation of the damper portion 10, so that it is desirable that the height of the protruding portion 80 is nine-tenths or less of the height of the damper portion 10.

A position at which the notch portion 81 is provided is desirably in an area described below. If viewed from the direction (the Z direction) in which the protruding portion 80 protrudes, a line segment 15 is drawn starting from a center of gravity 18 of the communication hole 38 and passing through a portion of the damper portion 10 at a position farthest from the center of gravity 18. In a case where a perpendicular line 16 of the line segment 15 is drawn from a center 17 of the line segment 15, it is desirable that the notch portion 81 is formed in an area closer to the communication hole 38 out of the two areas divided by the perpendicular line 16 inside the damper portion 10. Furthermore, in a case where a perpendicular line is drawn from each point dividing the line segment 15 into three equal parts to divide the inside of the damper portion 10 into three areas, it is desirable that the notch portion 81 is formed in an area closest to the communication hole 38. If the notch portion 81 is formed at a position closer to the communication hole 38, the inside of the sub tank 36 can easily communicate with the outside air. The present invention, however, is not limited to the above-described configuration. The inside of the sub tank 36 can easily communicate with the outside air by providing the notch portion 81 not only at the position closer to the communication hole 38 but also at any part.

It is desirable that the protruding portion 80 is formed near the communication hole 38. In other words, it is desirable that the protruding portion 80 is formed in an area in which the communication hole 38 is formed in the bisected areas, in a case where an inner area of the damper portion 10 is bisected when viewed from the Z direction. The protruding portion 80 is formed near the communication hole 38, and thereby the damper portion 10 can be further suppressed from blocking the communication hole 38 in the leakage inspection described below.

(Leakage Inspection)

Figure 10A:
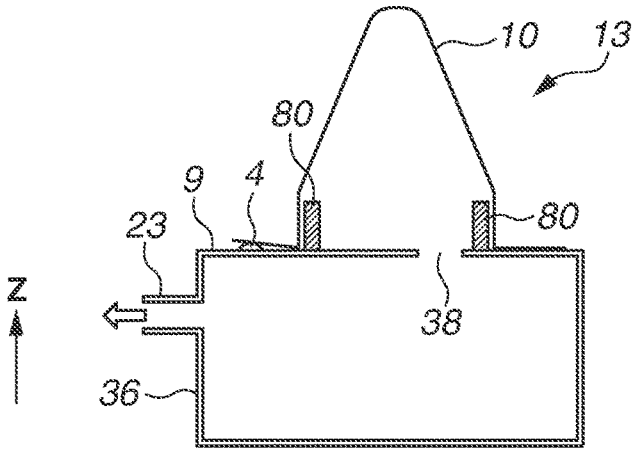
FIGS. 10A to 10C are schematic diagrams illustrating the damper portion in a leakage inspection.
Figure 10B:
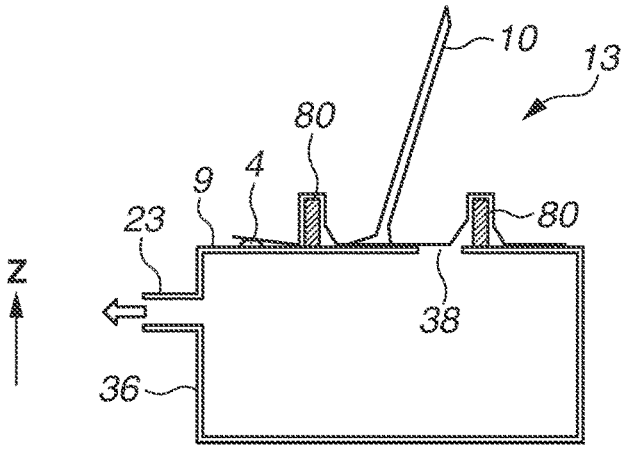
Figure 10C:
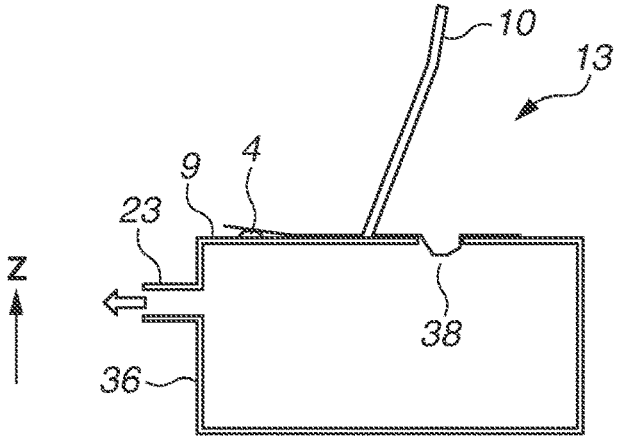

The leakage inspection of the damper portion 10 will now be described with reference to FIGS. 10A to 10C, and 11. FIGS. 10A to 10C are schematic diagrams illustrating states of the damper portion 10 at the time of the leakage inspection. FIG. 10A is a schematic diagram illustrating the ink tank 13 according to the present exemplary embodiment in a state in which a foreign substance 4 is sandwiched between the damper portion 10 and the sub tank lid 9. FIG. 10B is a schematic diagram illustrating a shape of the damper portion 10 in a case where the inside of the sub tank 36 is depressurized from the state illustrated in FIG. 10A. FIG. 10C is a schematic diagram illustrating an ink tank 13*a* as a comparative example corresponding to FIG. 10B and a shape of the damper portion 10 in a case where the protruding portion 80 is not provided in the sub tank lid 9.

In the leakage inspection, it is inspected whether the damper portion 10 and the sub tank lid 9 are sealed (closed). The leakage inspection is performed in such a manner that the inside of the sub tank 36 is sucked (depressurized) from the needle receiving portion 23, the suction operation is stopped, and subsequently a degree of pressure decrease is measured in the sub tank 36 after a lapse of a certain period of time. If the damper portion 10 and the sub tank lid 9 are properly sealed, the pressure in the sub tank 36 hardly changes even if the certain period of time elapses after the suction operation is stopped. This is because the inside of the sub tank 36 is closed. In contrast, if the foreign substance 4 is sandwiched at a seal surface between the damper portion 10 and the sub tank lid 9, the damper portion 10 and the sub tank lid 9 are not sealed, and the pressure in the sub tank 36 gradually increases with a lapse of time. This is because the outside air flows into the sub tank 36 via the damper portion 10 through a slight gap formed between the damper portion 10 and the sub tank lid 9. In the leakage inspection, it is inspected whether the damper portion 10 and the sub tank lid 9 are sealed by measuring a difference in a degree of increase in the pressure.

However, the pressure in the sub tank 36 may hardly increase in some cases even though the damper portion 10 and the sub tank lid 9 are not sealed. Such a case is illustrated in FIG. 10C. If the damper portion 10 is deformed as illustrated in FIG. 10C by the suction from the needle receiving portion 23, the deformed damper portion 10 may block the communication hole 38. Consequently, the pressure in the sub tank 36 hardly increases even if the certain period of time elapses after the suction operation is stopped, even though the inside of the sub tank 36 is closed and the damper portion 10 and the sub tank lid 9 are not sealed. In other words, the pressure change is similar to that in a case where it is properly sealed although it is not actually sealed, resulting in an erroneous inspection.

The protruding portion 80 including the notch portion 81 is therefore provided near the communication hole 38 as illustrated in FIG. 10B to avoid an erroneous inspection in the leakage inspection, according to the present invention. Since the protruding portion 80 is provided, the damper portion 10 comes into contact with the protruding portion 80 and is not further deformed even if the damper portion 10 is deformed by the suction. The communication hole 38 can thus be suppressed from being completely blocked. The slight gap formed between the damper portion 10 and the sub tank lid 9 is therefore in a state of communicating with the sub tank 36 via the notch portion 81 and the communication hole 38. If the damper portion 10 and the sub tank lid 9 are not sealed, the inside of the sub tank 36 and the outside (atmosphere) communicate with each other through the communication hole 38. The outside air thereby flows into the inside of the sub tank 36, and thus an erroneous inspection can be avoided in the leakage inspection.

Figure 11:
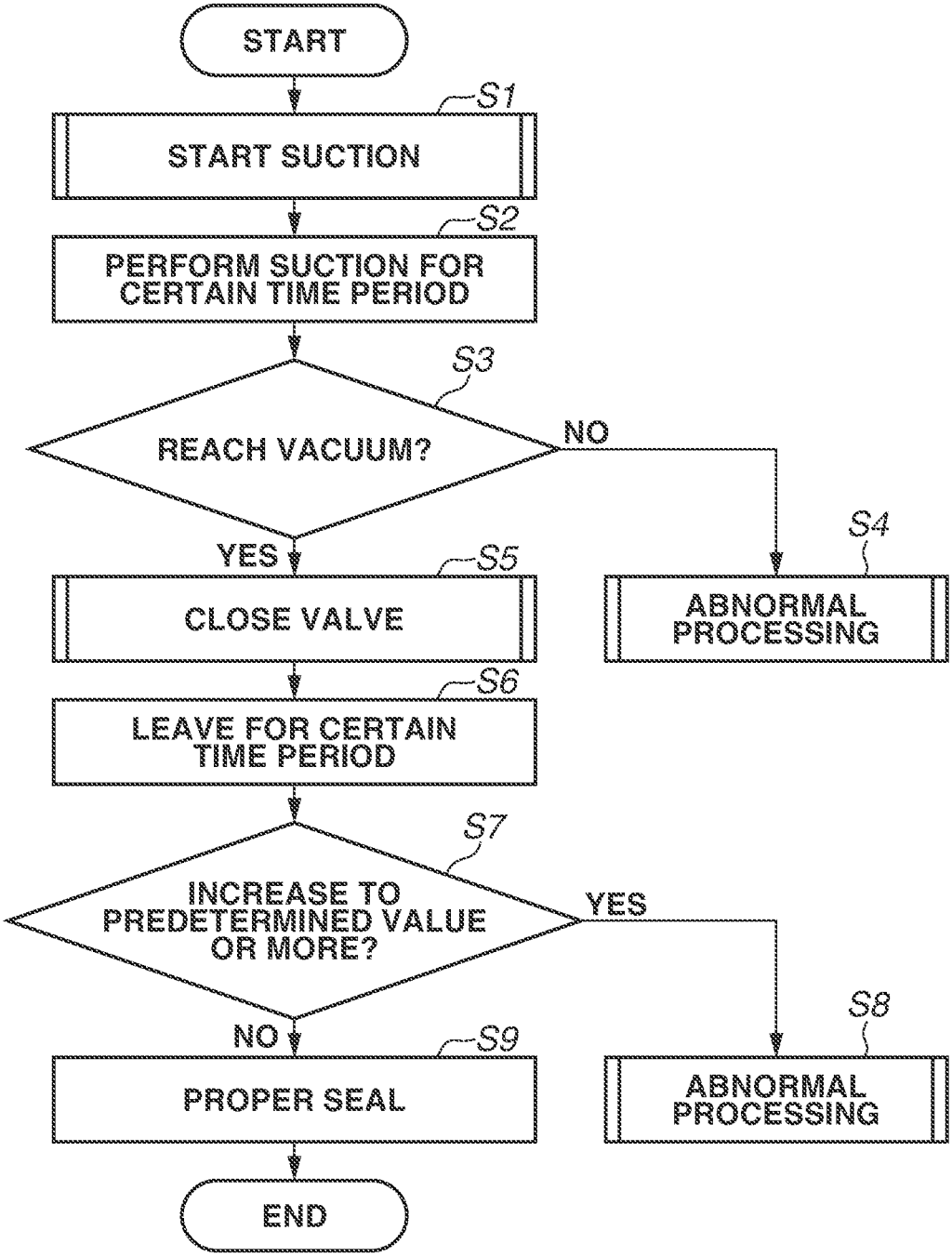
FIG. 11 is a flowchart illustrating processing for the leakage inspection.

A flow of the leakage inspection will now be described. FIG. 11 is a flowchart illustrating processing in the leakage inspection. First, the ejection port 29 on the element substrate 26 is covered with a film or a rubber cap. In step S1, a suction nozzle is then connected to the needle receiving portion 23 and starts suction in the sub tank 36 (a suction process). In step S2, the suction operation is performed for a certain time period (e.g., 10 seconds). In step S3, it is measured whether the inside of the sub tank 36 reaches a vacuum (approximately 0 to 20 kPa). In a case where the inside of the sub tank 36 does not reach the vacuum (NO in step S3), the processing proceeds to step S4. In step S4, it is determined that a leakage has occurred due to an obvious human error, and the leakage inspection is processed as abnormal. Examples of the obvious human error include incomplete assembly of the damper portion 10 to the sub tank lid 9, and a missing assembly of a necessary component.

If the inside of the sub tank 36 reaches the vacuum within the certain time period (YES in step S3), the processing proceeds to step S5. In step S5, a valve arranged between the sub tank 36 and the suction nozzle is closed while the suction nozzle is connected to the needle receiving portion 23. This makes the inside of the sub tank 36 a closed space. In step S6, the sub tank 36 is left for a certain time period (e.g., 20 seconds) (a leaving process). In step S7, it is measured to check whether the pressure inside the sub tank 36 increases to a predetermined value or more (a measurement process).

If the pressure inside the sub tank 36 increases to the predetermined value or more (YES in step S7), it is determined that the damper portion 10 and the sub tank lid 9 are not properly sealed (closed) and the processing proceeds to step S8. In step S8, the leakage inspection is processed as abnormal. A possible reason for the state in which the damper portion 10 and the sub tank lid 9 are not properly sealed may include entry of minute dust into a contact surface between the damper portion 10 and the sub tank lid 9, and a flaw on each component. If the pressure inside the sub tank 36 does not increase to the predetermined value or more (NO in step S7), the processing proceeds to step S9. In step S9, it is determined that the damper portion 10 and the sub tank lid 9 are properly sealed, and the leakage inspection is terminated.

Figure 12:
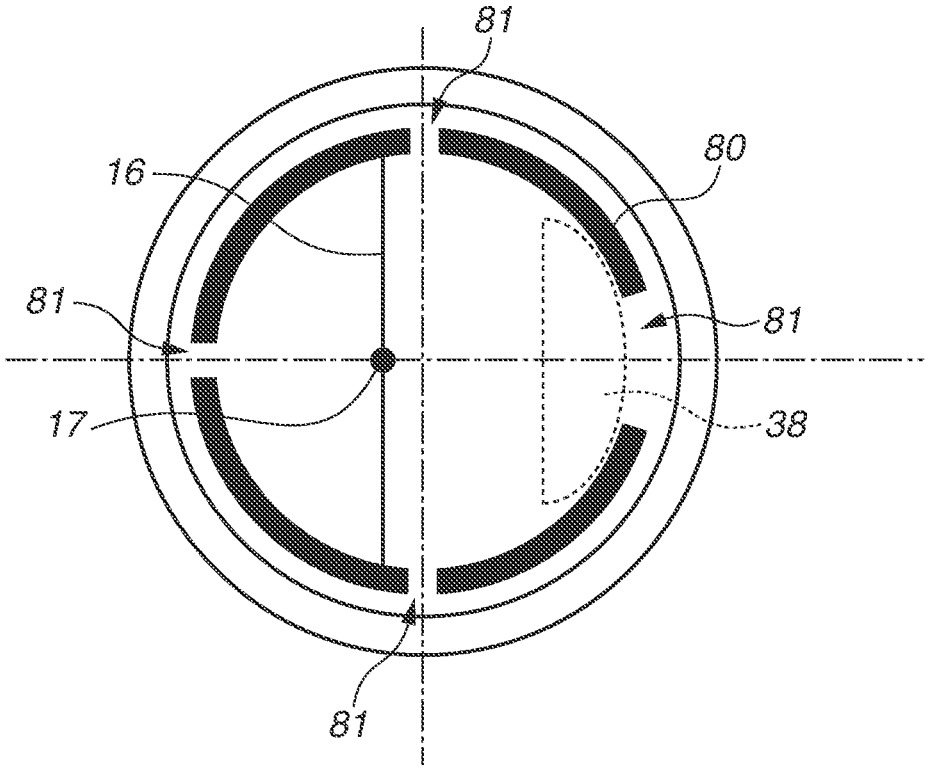
FIG. 12 is a schematic diagram illustrating a protruding portion according to a second exemplary embodiment.
Figure 13:
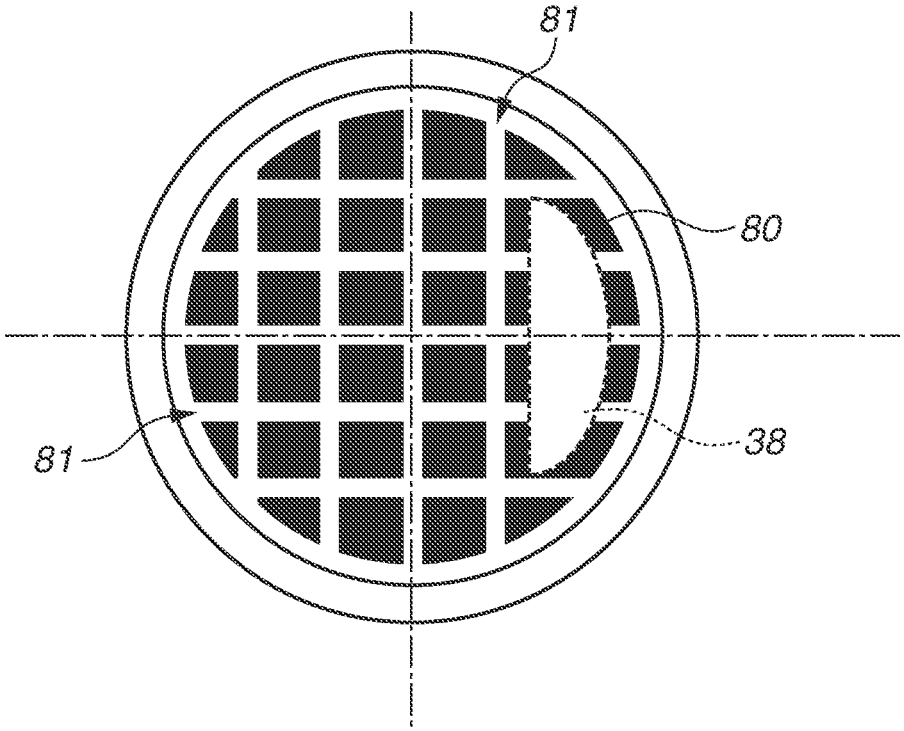
FIG. 13 is a schematic diagram illustrating a protruding portion according to the second exemplary embodiment.

A second exemplary embodiment will be described with reference to FIGS. 12 and 13. Parts similar to those according to the first exemplary embodiment are denoted by the same reference numerals, and descriptions thereof are omitted. FIGS. 12 and 13 are top views of the protruding portion 80 according to the second exemplary embodiment. According to the present exemplary embodiment, the notch portion 81 is formed in each of the two divided areas, in a case where an area of the sub tank lid 9 inside the damper portion 10 is divided into two areas by the perpendicular line 16. In FIG. 12, four notch portions 81 are arranged at equal intervals. According to the present exemplary embodiment, the notch portion 81 is provided in each of the two divided areas, and thus a passage of the outside air is further increased. It is thus possible to further suppress the damper portion 10 from sticking to the protruding portion 80 and making the inside of the sub tank 36 the closed space, and an erroneous inspection can be further suppressed in the leakage inspection. According to the present exemplary embodiment, the protruding portion 80 may be provided over an entire area of the sub tank lid 9 surrounded by the damper portion 10, and a large number of the notch portions 81 like a grid pattern may be provided as illustrated in FIG. 13. By employing the protruding portion 80 and the notch portions 81 illustrated in FIG. 13, further more passages of the outside air can be secured.

Figure 14:
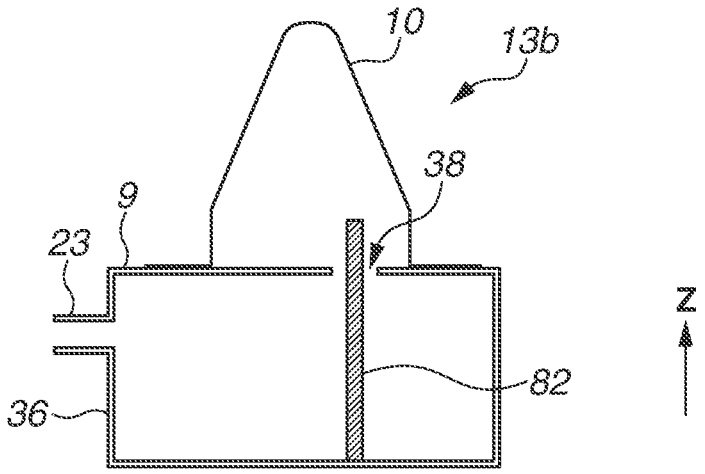
FIG. 14 is a schematic diagram illustrating a protruding portion according to a third exemplary embodiment.

A third exemplary embodiment will be described with reference to FIG. 14. Parts similar to those according to the first exemplary embodiment are denoted by the same reference numerals, and descriptions thereof are omitted. FIG. 14 is a schematic diagram illustrating an ink tank 13*b* according to the third exemplary embodiment. According to the present exemplary embodiment, a support column 82 is arranged, which is inserted from a bottom surface of the sub tank 36 through the communication hole 38 to the inner space 8 of the damper portion 10. In other words, according to the present exemplary embodiment, a portion on a tip end side of the support column 82 functions as the protruding portion 80 according to the present invention. As illustrated in FIG. 14, the portion on the tip end side of the support column 82 does not surround the communication hole 38. If the support column 82 is arranged, the damper portion 10 recessed in the leakage inspection comes into contact with the portion on the tip end side of the support column 82 and is suppressed from being further recessed. The communication hole 38 can thereby be suppressed from being blocked by the damper portion 10, so that an erroneous inspection can be suppressed in the leakage inspection also according to the present exemplary embodiment.

It is desirable that the support column 82 in using an ink-jet is inserted such that the tip end of the support column 82 is located at a height corresponding to a length of one-tenth or more of a total length of the damper portion 10 from the sub tank lid 9 side in the Z direction (an upper direction in a vertical direction). Inserting the support column 82 to the height of one-tenth or more of the damper portion 10 can suppress the deformed damper portion 10 from blocking the communication hole 38. If the position to which the support column 82 is inserted too high, there is a risk of hindering necessary deformation of the damper portion 10. It is therefore desirable that the tip end of the support column 82 is located at the height of nine-tenths or less of the height of the damper portion 10.

In FIG. 14, the support column 82 extends in a direction parallel to the Z direction. However, the present exemplary embodiment is not limited to this configuration. In other words, the support column 82 may be inserted at an angle with respect to the Z direction, and the same effect can be obtained in this case.

According to the present disclosure, an erroneous inspection can be suppressed in a leakage inspection of a damper portion and an ink storage portion.

While the present invention has been described with reference to exemplary embodiments, it is to be understood that the invention is not limited to the disclosed exemplary embodiments. The scope of the following claims is to be accorded the broadest interpretation to encompass all such modifications and equivalent structures and functions.

This application claims the benefit of Japanese Patent Application No. 2020-114209, filed Jul. 1, 2020, which is hereby incorporated by reference herein in its entirety.

What is claimed is:

1. An ink tank comprising:

an ink storage portion configured to store ink; and a flexible damper portion configured to communicate with an inside of the ink storage portion through a communication hole, wherein a protruding portion protruding from an ink storage portion side toward an inside of the damper portion is formed in the inside of the damper portion, wherein, when viewed from a direction in which the protruding portion protrudes, the damper portion surrounds an entire circumference of the communication hole, and wherein an opening portion is formed in the protruding portion.

2. The ink tank according to claim 1, wherein the opening portion is a notch portion.

3. The ink tank according to claim 2, wherein the notch portion is formed in a close area to the communication hole out of two areas of the inside of the damper portion when viewed from the direction in which the protruding portion protrudes, the two areas being made by drawing a perpendicular line from a center of a line segment starting from a center of the communication hole and reaching a portion of the damper portion located farthest from the center of the communication hole.

4. The ink tank according to claim 3, wherein the notch portion is formed in each of the two areas.

5. The ink tank according to claim 1, further comprising an ink storage portion lid forming one surface of the ink storage portion, wherein the damper portion and the protruding portion are provided in the ink storage portion lid.

6. The ink tank according to claim 5, wherein a height of the protruding portion from the ink storage portion lid is greater than or equal to one-tenth of a height of the damper portion from the ink storage portion lid.

7. The ink tank according to claim 5, wherein a height of the protruding portion from the ink storage portion lid is greater than or equal to one-fifth of a height of the damper portion from the ink storage portion lid.

8. The ink tank according to claim 5, wherein a height of the protruding portion from the ink storage portion lid is greater than or equal to one-third of a height of the damper portion from the ink storage portion lid.

9. The ink tank according to claim 5, wherein a height of the protruding portion from the ink storage portion lid is less than or equal to nine-tenths of a height of the damper portion from the ink storage portion lid.

10. The ink tank according to claim 1, wherein, when viewed from the direction in which the protruding portion protrudes, the protruding portion is formed between the damper portion and the communication hole.

11. The ink tank according to claim 1, wherein when viewed from the direction in which the protruding portion protrudes, the protruding portion is formed in an area in which the communication hole is formed in two bisected areas obtained in a case where an inner area of the damper portion is bisected.

12. An ink tank comprising:

an ink storage portion configured to store ink; and a flexible damper portion configured to communicate with an inside of the ink storage portion through a communication hole, wherein a protruding portion protruding from an ink storage portion side toward an inside of the damper portion is formed in the inside of the damper portion, and wherein, in a case where the inside of the ink storage portion is depressurized, the damper portion comes into contact with the protruding portion, and the inside of the ink storage portion and the inside of the damper portion communicate with each other through the communication hole.

13. A leakage inspection method for inspecting a connection state of an ink storage portion and a damper portion in an ink tank, the ink tank including the ink storage portion for storing ink, the flexible damper portion connected to the ink storage portion for suppressing a fluctuation in a pressure inside the ink storage portion, and a protruding portion protruding from an ink storage portion side toward an inside of the damper portion, the inside of the damper portion and the inside of the ink storage portion being communicated with each other through a communication hole, wherein the damper portion surrounding an entire circumference of the communication hole when viewed from a direction in which the protruding portion protrudes, and wherein an opening portion being formed in the protruding portion, the leakage inspection method comprising:

sucking the inside of the ink storage portion;

stopping the suction and leaving the ink storage portion for a certain time period; and measuring a pressure inside the ink storage portion after a lapse of the certain time period, wherein the damper portion deformed in the suction comes into contact with the protruding portion.

* * * * *